United States Patent [19]

Gartlacher

[11] Patent Number: 4,934,862

[45] Date of Patent: Jun. 19, 1990

[54] ROAD MARKER

[76] Inventor: John Gartlacher, 87 Fennell Street, North Parramatta, New South Wales, Australia

[21] Appl. No.: 268,155

[22] Filed: Nov. 7, 1988

[30] Foreign Application Priority Data

Nov. 11, 1987 [AU] Australia ..... PI5374

[51] Int. Cl.[5] ..... G08B 1/00

[52] U.S. Cl. ..... 404/14; 404/16

[58] Field of Search ..... 404/9, 12, 14, 15, 16; 350/97, 102, 103, 109; 116/63 R

[56] References Cited

U.S. PATENT DOCUMENTS

| | | | |
|---|---|---|---|
| 2,328,407 | 8/1943 | Beeker | 404/16 |
| 3,516,337 | 3/1968 | Gubela | 404/9 |
| 4,088,416 | 5/1978 | Taylor | 404/15 |
| 4,232,979 | 11/1980 | Johnson | 404/16 |
| 4,717,281 | 1/1988 | Shepherd | 404/9 |

FOREIGN PATENT DOCUMENTS

| | | | |
|---|---|---|---|
| 2434064 | 1/1976 | Fed. Rep. of Germany | 404/16 |
| 2536839 | 3/1977 | Fed. Rep. of Germany | 404/16 |
| 3615786 | 11/1986 | Fed. Rep. of Germany | 404/9 |
| 2483976 | 12/1981 | France | 404/9 |

*Primary Examiner*—Jerome W. Massie
*Assistant Examiner*—Gay Ann Spahn
*Attorney, Agent, or Firm*—Edwin D. Schindler

[57] ABSTRACT

A road marker having a body with an internal slot recess adjacent an edge of the body accessible from the underface of the body, a reflector panel housed in the slot recess with end and width clearance in the slot recess and with a thickness such that the panel is a sliding fit in the slot recess, retaining means to retain the panel in the slot recess and an aperture in an edge of the body communicating with the slot recess to allow viewing of portion of the reflector panel housed in the slot recess.

9 Claims, 2 Drawing Sheets

ROAD MARKER

Figure 1:
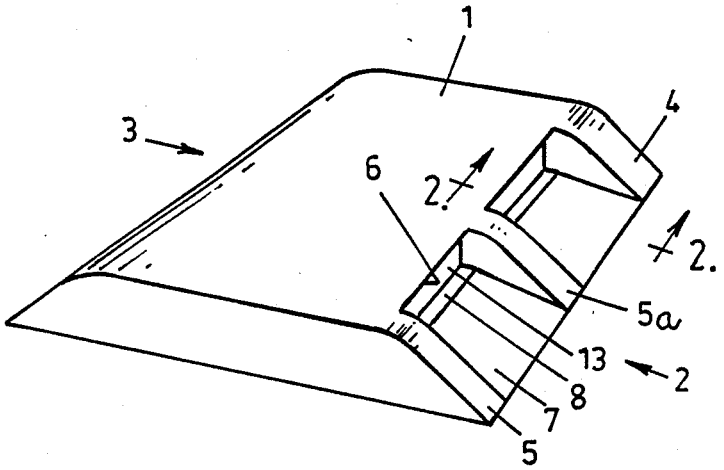

This invention relates to road markers, that is devices incorporating light reflecting material or members and used to indicate a division between road lanes. The markers can of course have other uses, on the edges of culverts and other locations where an indication needs to be given to the driver of a vehicle as to safe and/or non-safe areas for vehicular traffic. Such markers are usually affixed by adhesive to a support, e.g. a road or a post.

The invention is primarily concerned with road markers of the type which go on the carriageway and which are subjected to surface contact with the wheels of vehicles. In the past road markers for this purpose have comprised a body of robust design manufactured from an abrasive resistant plastics material or metal.

In one form of such marker the reflective medium to pick up light from the headlights of vehicles and reflect it back at the driver comprised a plurality of glass prisms of particular design. The manufacture of this type of marker involved the molding of the body as a substantially rectangular block of shallow height with prism recesses in the body edges and then the mounting of the prisms in the recesses. The prisms projected a small distance from the edges of the body but not so far as to be engaged by the wheel of a vehicle riding over the body. However in their extended exposed position the prisms were subjected to deposition of road grime and other materials as might be dropped from vehicles and accordingly their efficiency quickly deteriorated.

In another form of road marker a body was provided with two opposite edge faces which were at a shallow angle to the base of the body. The angled faces provided a smooth path for a wheel travelling along the carriageway to pass up and over the road marker. The angle faces were provided with a molded pattern of prismatic angles or corner cubes on the inside, generally with a mirrored coating, to provide an effective array of point sources of light when exposed to vehicle headlights. These markers, which usually had an outer shell made of an acrylic material, had an effective life which was quite limited because the inclined exterior surfaces over which the wheels of road vehicles frequently passed soon scratched and marked and this inhibited the passage of light through the surface to the reflective members, and necessarily the amount of light available for reflection back at the driver. It is to be noted that this type of road marker was also manufactured in body forms having other than two sides.

This invention provides a simple and efficient road marker which utilizes a highly reflective inexpensive sheet material housed within a body so as to have the light absorbing and retransmitting surfaces protected from the wheels of road vehicles and so as to be isolated from shock. In a preferred form of the road marker according to the invention the reflective member is housed in a manner which discourages the deposition of road grime on light transmitting surfaces. The manner in which the reflective member is installed results in a road marker which is simple and economical to manufacture.

Broadly stated the invention can be said to comprise a road marker including a body with a slot recess extending into the body from an underface of the body and located adjacent an edge of the body, said recess comprising a retainer housing first portion immediately adjacent the body underface and a second portion extending into the body from the first recess portion, the second recess portion has a length greater than the length of a panel having light reflecting properties housed in the second recess portion so as to provide an end buffer zone at each end of the panel and the second recess portion has a depth greater than the width of the panel to provide an edge buffer zone for an edge of the panel remote from the first recess portion and the second recess portion has a width substantially equal to but less than the thickness of the panel so as to permit the panel to be entered with sliding clearance into the second recess portion, a panel retaining means in the first recess portion and an aperture in the edge of the body communicating with the second recess portion to expose a portion of the panel to view.

Figure 2:
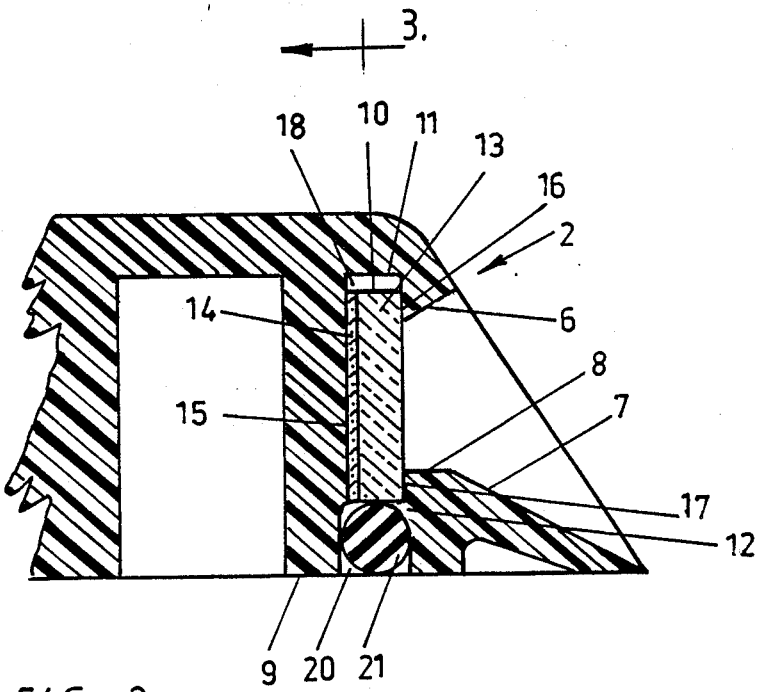
Figure 3:
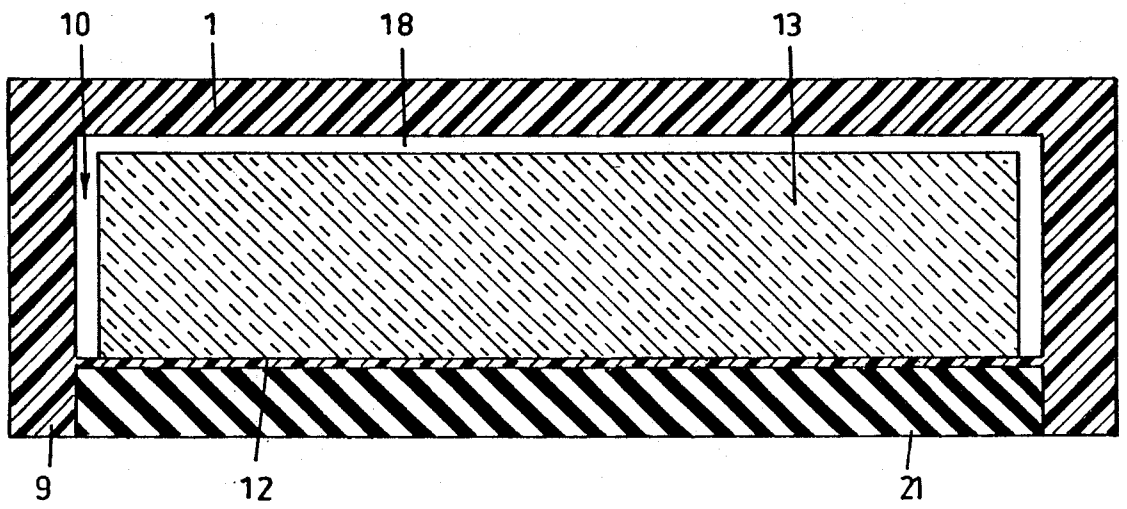

A presently preferred form of the invention will now be described with reference to the accompanying drawings in which: FIG. 1 is a perspective view of a road marker according to the invention fitted with a single reflective member, FIG. 2 is an enlarged fragmentary sectional view on the section line 2—2 of FIG. 1 and FIG. 3 is an enlarged sectional view on the section line 3—3 of FIG. 2.

In FIG. 1 the road marker has a body 1 which is generally square in shape with angled leading and trailing edges 2 and 3 with the edges and the underface of the maker having an acute angle therebetween. It will be understood that the road marker can have reflecting means associated with one or other of the edges 2 or 3. It will also be understood that the road marker may have one, three, four or more angled edges and the reflecting means may be associated with one or more of those edges. In other words the general configuration of the road marker is not important.

The reflective means is housed within the body adjacent the edge 2 in a recess to be described in detail later. An aperture is provided in the edge 2 between two abutment faces 4 and 5 and, as will be best seen from FIG. 2 the aperture in the preferred form of the invention has several parts. There is an inwardly inclined upper face 6, an upwardly inclined lower face 7 terminating in a face 8 parallel to the underface 9 of the body 1. The face 8 is preferred but not essential. The aperture communicates with the recess within the body which is in the form of a slot 10 open to the underface 9 of the body 1. In the preferred arrangement there is a central reinforcement rib 5*a*, but it is to be understood that in some designs the rib may not be required or there may be more than one rib needed to provide the strength demanded by the use location of the marker.

The slot 10 is long enough in the lateral direction of the body and deep enough between its bottom 11 and a retaining lip 12 (to be described later) to house a reflective panel comprised of a transparent support 13 (preferably made of glass) to the rear face of which is adhered sheet reflective material 14. The width of the slot between its back face 15 and the portions 16 and 17 is such as to receive the panel 13/14 as a firm sliding fit. The difference in depth of the slot 10 and the width of the panel exceeds the length of the lip 12 for reasons to be explained later.

As will be seen from FIGS. 2 and 3 there is a buffer zone at each end of the panel and above the panel for reasons to be explained. It is also to be noted that the length of the aperture is less than the length of the panel by an amount in excess of the difference in length between the panel and the slot 10, this ensures that if the panel moves lengthwise in the slot the ends of the panel will not enter the aperture, for reasons to be explained later. For similar reasons the breadth of the aperture is less than the width of the panel by an amount in excess of the difference between the panel width and the depth of the slot 10.

The buffer zones allow cushioning of shocks applied to the road marker, as by blows from passing vehicle wheels. The buffer zones can be utilized as air space, any movement of the insert is cushioned by compression of the air trapped in the spaces or the spaces can be filled with a shock absorbing material, e.g. a resiliently deformable plastics material. As glass is the preferred material for the transparent support 13 it is desirable that a shock absorbing medium, e.g. air under compression or yielding of resilient plastic, be provided to isolate the support as efficiently as possible from road shocks.

The reflective panel is introduced into the slot 10 from the underface 9 of the body. The panel is forced passed the lip 12 which is resiliently deflectable and which will be able, because of the end buffer zone 18 allowing the panel to be pushed well passed the lip, to spring out below the bottom edge of the panel and retain it in the slot 10. The portion 20 of the slot below the lip 12 is wider than the slot 10 above the lip 12 and is adapted to resiliently receive a sealing rod and retaining rod 21. The rod 21 is preferably made of a plastics material and is forced into the slot portion 20 so as to seal against the sides and ends of the slot portion 20 thereby effectively sealing the slot against the ingress of foreign materials, for example the adhesive may be used to secure the road marker to a surface.

It will be seen from the foregoing that the reflective panel is simply and safely mounted within the road marker in a manner substantially isolating it from shocks. The exposed surface of the support part of the reflective panel is housed in a manner such that it is not exposed to abrasion by vehicle wheels. The form of the aperture has been designed to create an air circulation path within the aperture which will, with the passage of a wheel over the road marker, create a current of air into and out of the aperture to prevent deposition of moisture and road dust on the exposed surface of the support 13. Accordingly, it will be seen that the present invention provides a road marker having substantial advantages over road markers now in use both from economical, manufacturing, durability and service viewpoints.

I claim:

1. A road marker, comprising:

a reflector panel;

a body, said body having a slot recess extending into said body from an underface of said body and lying adjacent a front face of said body, the slot having a vertical depth between the underface of said body and the top of the slot, which is comprised of an inner part to hold said reflective panel and an outer part which lies adjacent the underface of said body, the slot having a horizontal length dimension in a direction from side to side of said body and a horizontal width dimension in the direction from the front face of said body to a back of said body; and, means for retaining said reflector panel in the outer part of the slot, said reflector panel having a length less than the length of the slot and a width less than the height of the inner part of the slot to provide length and height clearances between said reflector panel and ends and the top of the inner part of the slot, said reflector panel having a thickness which is less than the width of the slot by an amount allowing for said reflector panel to be entered with a sliding clearance into the inner part of the slot; and, said body further including an aperture extending into said body from the front face of said body in a direction parallel to the underface of said body and intersecting with the inner part of the slot so as to expose a part of a reflective face of said reflector panel to view from outside of said road marker.

2. The road marker as claimed in claim 1, further comprising a flexible member extending in the width direction of the slot across at least a part of the width of the inner part of the slot and separating the inner part and the outer part of the slot, said flexible member being sufficiently deflectable in order to allow said reflector panel to be entered into the inner part of the slot.

3. The road marker as claimed in claim 1, further comprising a removable resilient sealing member housed under deforming pressure in the outer part of the slot and substantially fully occupying the outer part of the slot.

4. The road marker as claimed in claim 1, wherein the front face of said body is in a plane at an acute angle to a plane of the underface of said body.

5. The road marker as claimed in claim 1, further comprising an upper face and a lower face in order to define the height of the aperture with an upper face angle and a lower face angle being relative to one another and divergent in a direction away from said reflector panel.

6. The road marker as claimed in claim 1, further comprising resiliently deformable material occupying said length and said height clearances.

7. The road marker as claimed in claim 1, including further reflector panel occupied slots adjacent other faces of said body.

8. The road marker as claimed in claim 1, wherein said reflector panel includes a sheet of transparent glass and a sheet of light reflective material bonded to the glass with the glass adjacent the body aperture.

9. The road marker as claimed in claim 1, further comprising divider means to divide the aperture in the length direction of the slot into two or more parts.

* * * * *